US005913348A

United States Patent [19]

Horton

[11] Patent Number: 5,913,348

[45] Date of Patent: Jun. 22, 1999

[54] BRUSH HAVING EXTENDABLE BRISTLES AND METHOD FOR MAKING SUCH A BRUSH

[76] Inventor: Robert C. Horton, 9790 Gulf Shore Dr., #304, Naples, Fla. 34108

[21] Appl. No.: 08/975,814

[22] Filed: Nov. 21, 1997

[51] Int. Cl.[6] ..... A46B 3/00; A46B 17/04

[52] U.S. Cl. ..... 15/196; 15/169; 15/201; 300/21

[58] Field of Search ..... 15/159.1, 167.3, 15/168, 169, 190, 191.1, 195, 196, 201, 204, 205; 300/21

[56] References Cited

U.S. PATENT DOCUMENTS

| | | | |
|---|---|---|---|
| 1,080,633 | 12/1913 | Husch | 15/159.1 |
| 1,180,827 | 4/1916 | Chott | 15/205 |
| 1,639,388 | 8/1927 | Stebbings | 15/184 |
| 1,849,733 | 3/1932 | Pfeffer | 15/160 |
| 2,244,336 | 6/1941 | Horn | 15/169 |
| 2,442,051 | 5/1948 | Luscri | 15/169 |
| 3,193,863 | 7/1965 | Myers et al. . | |
| 4,387,480 | 6/1983 | Cobianco . | |

FOREIGN PATENT DOCUMENTS 377752 9/1907 France .

*Primary Examiner*—Terrence R. Till
*Attorney, Agent, or Firm*—M Lukacher; R. C. Brown

[57] ABSTRACT

An extendable-bristle brush having a hollow, tubular handle containing a folded bundle of fibers, the free ends of the fibers extending from an open end of the handle as bristles. The bundle is formed by folding a half-bundle of fibers about a hooked drawpiece and drawing the fold of the bundle into the handle so that both ends of each fiber protrude from the same end of the tubular handle to form the bristles of the brush. Folding of the bundle creates a bulge in the bundle which is slightly larger than the inner diameter of the tubular handle. Drawing the bundle into the handle compresses the bulge, resulting in a holding force which frictionally locks the bundle within the handle. The bundle may be advanced by pulling out the exposed bristles. As the bundle is repeatedly pulled out and cut off for additional uses, the holding force does not change significantly with shortening of the bundle or the handle. The handle is preferably resilient and may be corrugated into a bellows, the perstaltic extension and contraction of which can expose new bristles. The bellows also permit the handle to be bent so that the brush may be used in awkward situations. A plurality of individual brushes may be ganged to provide a larger brush.

25 Claims, 5 Drawing Sheets

BRUSH HAVING EXTENDABLE BRISTLES AND METHOD FOR MAKING SUCH A BRUSH

DESCRIPTION

The present invention relates to bristled brushes, and more particularly to brushes wherein the bristles may be displaced outwardly of, or retracted inwardly of, the brush handle as desired by the user, and most particularly to a brush wherein the bristles may repeatedly be cut off and fresh bristles advanced from within the handle.

A "brush" as used herein is a device composed of bristles set into a handle and used especially for sweeping, scrubbing, or painting. Typically, the inner ends of the bristles of a brush extend inwardly of the handle, for example into a cavity therein, and are secured by being bound by a collar to the handle or by being glued therein. Further as used herein, the individual strands of fibrous material in a brush are referred to interchangeably as "filaments" and as "fibers." The term "bristles" means the extensions of filaments or fibers exposed from the handle.

A shortcoming of a brush having bound or glued bristles is that the length and amount of bristle exposed and available for work is fixed by the manufacturer and cannot be changed over the working life of the brush. When the exposed bristles become worn, irregular, fouled, or otherwise unfit for further use, the entire brush must be discarded even though the handle and unexposed filaments may be perfectly serviceable.

Improved brushes have been proposed wherein the bristles are not immovably bound to the handle but rather can be advanced by the user from an opening in the end of the handle to provide a fresh length of bristle, the worn bristles being cut off and discarded. When the cavity in the handle is relatively deep, or the handle is a continuous tubular member, long filaments extending deep into the handle may be provided which may be advanced repeatedly to provide fresh bristles a substantial number of times.

French Patent No. 377,752 issued Sep. 14, 1907, to Phateco GmbH discloses a brush having long bristles extending from an open end of a capped tubular handle. When the bristle ends are soiled or stuck together or used up, the user cuts off the end of the bristle bundle and pulls out new bristle. No method is disclosed for making such a brush, and no provision is made for keeping the bristles from either sliding out of the handle or being pushed back into the handle in use. Further, there is no mechanism disclosed for retracting the bristles into the handle if so desired by the user.

U.S. Pat. No. 3,192,863 issued Jul. 13, 1965, to Myers et al. discloses a brush having a hollow handle being threaded along a portion of the inner surface thereof. Bristles are fixed to an axially movable socket disposed within the handle and are advanceable by rotation of a pusher member threaded to mate with the threads in the handle, similar to the rotatable mechanism of a mechanical pencil. Such a brush is relatively complex, can have several moving parts, and can be relatively costly to manufacture.

U.S. Pat. No. 4,387,480 issued Jun. 14, 1983, to Cobianco discloses a brush similar to the French '752 brush which recognizes the problem of providing bristles which are easy to advance and yet are maintainable at a desired length of advance. The brush is provided with a wire lanyard wound around the fiber bundle within the handle and led forward along the bundle to an exit near the working tip of the handle. Fibers are advanced by a pull on the lanyard. The brush is further provided with a rotatable cylinder disposed transversely across a portion of the fiber path within the handle to provide frictional assist in advance or statis of the bristles. No disclosure is made that the bristles can be withdrawn into the handle as desired by the user, and no method is disclosed for making such a brush.

Thus a need exists for a brush having bristles which can be extended from or retracted into the handle by the user, which bristles will automatically remain at any desired extension during use, and for a method by which such a brush may be simply and inexpensively manufactured.

It is a principal object of the invention to provide an improved brush wherein the bristles are readily extendable from the handle and are automatically held at any desired extension during use.

It is a further object of the invention to provide an improved brush wherein the bristles may be extended from or withdrawn into the handle as desired by the user.

It is a still further object of the invention to provide an improved extendable-bristle brush which is simple and inexpensive to manufacture.

It is a still further object of the invention to provide a method for manufacturing a simple and inexpensive extendable-bristle brush.

Briefly described, an extendable-bristle brush embodying the invention includes a hollow, tubular handle open at both ends and containing a snugly-fitting bundle of fibers, the ends of the fibers extending from one of the open ends of the handle as bristles. The bundle of fibers is formed by gathering approximately one-half the number of fibers desired in the final bristles; folding the half-bundle back on itself near or at its midpoint about a hooked drawpiece first passed through the hollow handle; and drawing the hook holding the folded bundle into the handle so that both ends of each fiber protrude from the same end of the tubular handle to form the extending bristles of the brush. The drawpiece may then be removed from the bundle or may be left in place.

The folding of the bundle creates a bulge in the bundle which is slightly larger than the non-bulge diameter of the folded bundle and, when non-compressed, is preferably slightly larger than the inner diameter of the tubular handle. Drawing the bundle into the handle compresses the bulge to form an automatic frictional lock of the bundle within the handle. The bundle may be advanced by pulling on the exposed bristles, but after advance the bundle is again locked in place simply by friction of the bulge within the handle.

This is an important improvement over prior art brushes which lack the fold bulge and instead must rely on friction along the entire length of the filament bundle against the bore in the handle to hold the bundle in place. As the bundle in such brushes is repeatedly pulled out and cut off to renew the bristles, the remaining bundle is progressively held less securely since it becomes progressively shorter. Since the holding force in the present invention is provided almost entirely by friction between the bulge and the bore, the holding force does not change significantly with shortening of the bundle or the handle.

In some applications, it may be desireable to provide an additional shim within the bulge to increase its effective size. This is easily accomplished by removably installing it on the drawpiece prior to gathering of the filaments for folding and leaving it within the bulge in the bore upon removal of the drawpiece.

In a further embodiment of the invention, the handle of the brush may be resilient and may be cylindrically corrugated over a portion of its length to provide an axially-extendable bellows, the extension or contraction of which can serve to length or shorten the handle containing the folded fiber bundle and thereby to extend or retract peristaltically the length of exposed bristles. The bellows also permits the handle to be bent so that the brush may be used in otherwise awkward situations such as around corners in which a rigid handled straight brush is unable to reach the surface to be brushed or painted.

Brushes provided in accordance with the invention can be used a plurality of times by simply advancing the filament bristles from the handle and cutting off the used length of bristles on the outer end. In the embodiment incorporating a bellows in the handle, the used length may be cut off before the bundle is advanced. An extremely sharp edge of bristles can be obtained by severing both the end of the tubular handle and the bristles contained therein with a very sharp tool such as a razor blade, then advancing the fiber bundle to expose the new length of bristles. The bellows also permit the bristles to be retracted or withdrawn into the handle if desired, for example, to prevent the drying out of paint or glue in the bristles between applications.

The foregoing and other objects, features, and advantages of the invention, as well as presently preferred embodiments thereof, will become more apparent from a reading of the following description in connection with the accompanying drawings in which:

FIGS. 1*a* and 1*b* are cross-sectional views of first and second embodiments of brushes in accordance with the invention;

FIGS. 2*a*, 2*b*, 2*c*, and 2*d* are schematic views of four sequential steps in making a brush in accordance with a method of the invention;

Figure 1A:
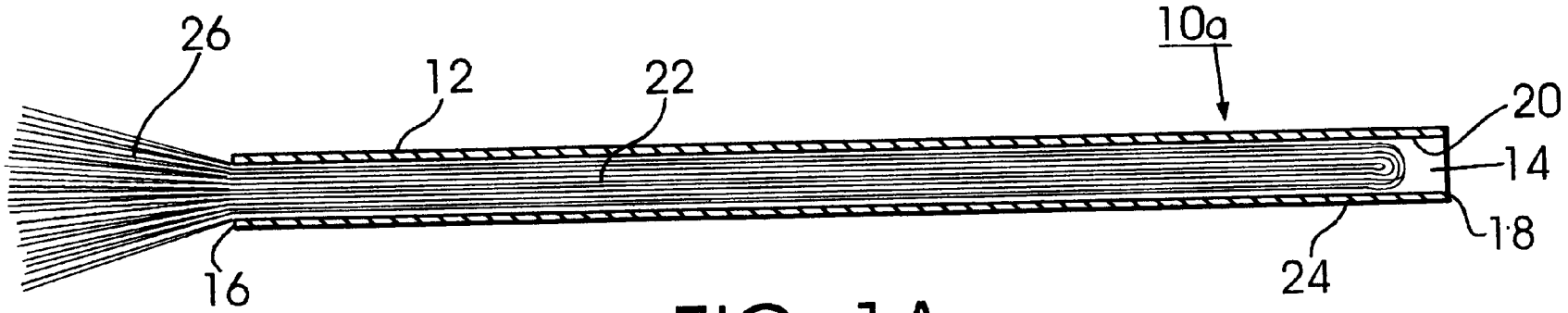
Figure 3:
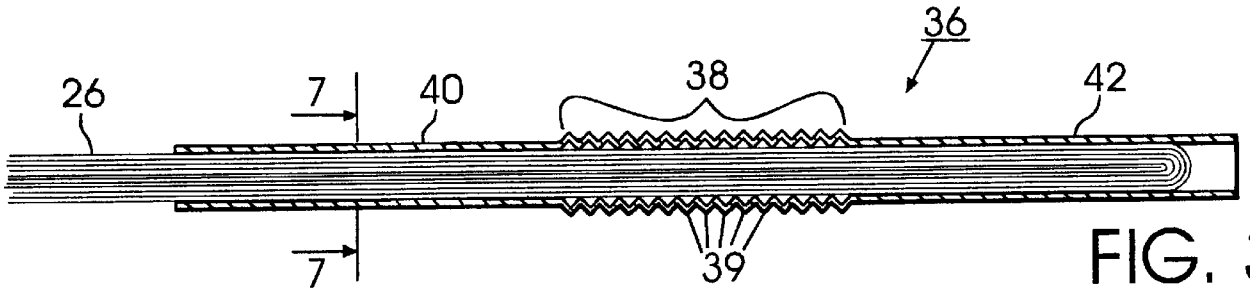
FIG. 3 is a cross-sectional view of a third embodiment of a brush, showing a bellows in the handle.
Figure 7A:
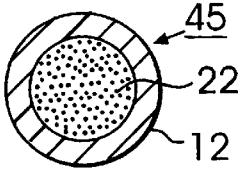
Figure 7B:
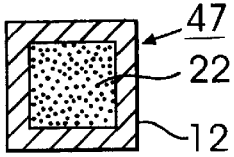
Figure 7C:
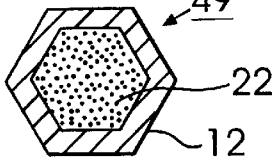
Figure 8A:
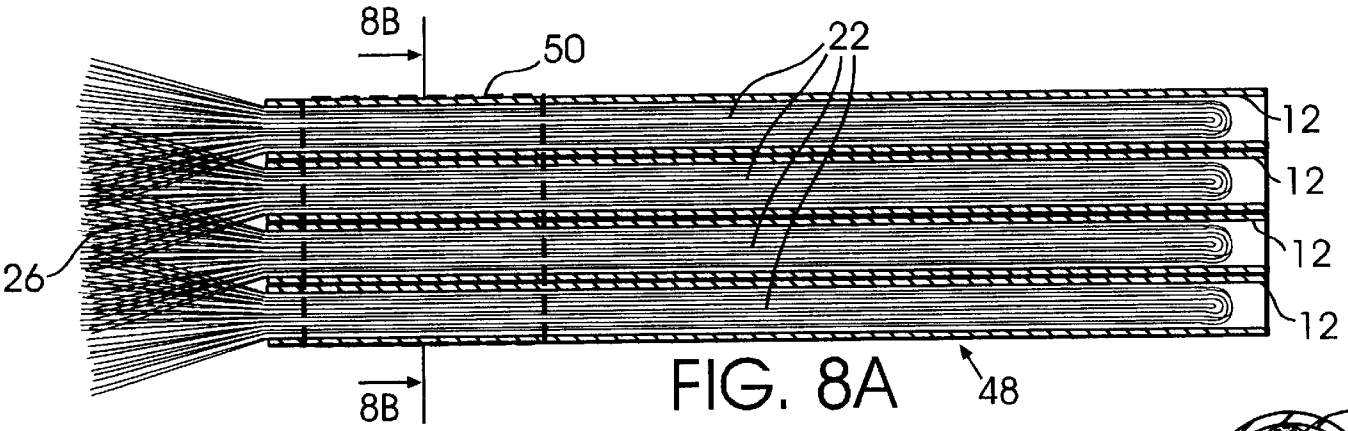
Figure 8B:
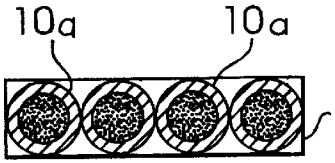
Figure 9:
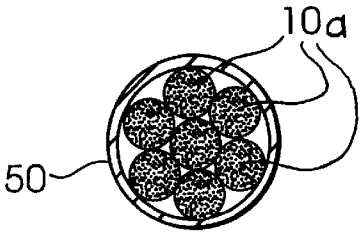

FIGS. 6*a* through 6*g* are sequential cross-sectional views of the brush of FIG. 3, showing steps in a method of the invention to advance a fresh length of bristles peristaltically from within the brush;

FIGS. 7*a* through 7*c* are cross-sectional views taken along line 7—7 in FIG. 3 showing some examples of various possible cross-sectional geometric shapes of brushes in accordance with the invention;

FIG. 8*a* is a cross-sectional view of a first embodiment of a ganged brush showing a plurality of individual brushes like the brush shown in FIG. 1*a* conjoined to form a larger brush;

FIG. 8*b* is a cross-sectional view taken along line 8*b*—8*b* in FIG. 8*a*; and FIG. 9 is a cross-sectional view of a second embodiment of a ganged brush in accordance with the invention.

Figure 1B:
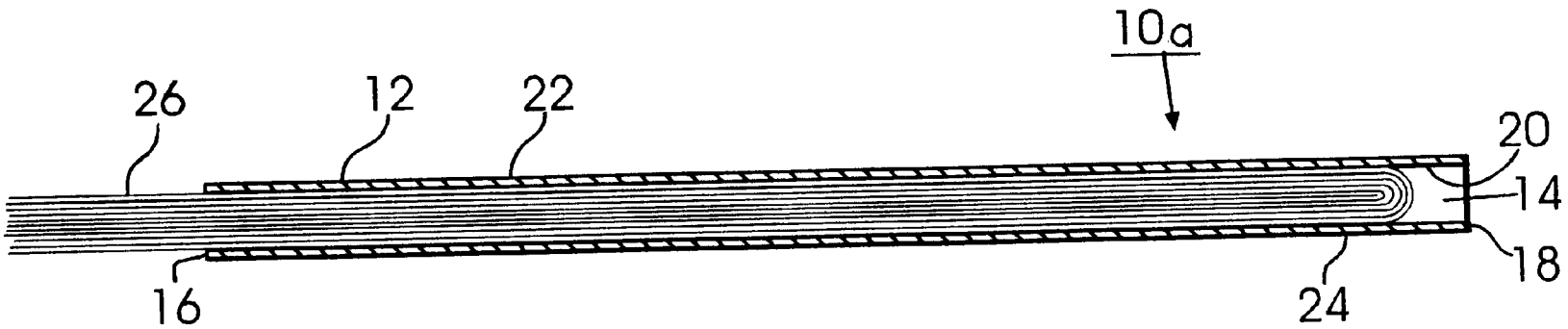

Referring to FIGS. 1*a* and 1*b*, there are shown brushes 10*a* and 10*b*, respectively, which differ only in the material comprising the fiber or filament bundle and bristles as discussed below. The tubular handle 12 of either brush 10*a* or 10*b* has an axial bore 14 which is open at first end 16 and second end 18 and has a wall surface 20. Handle 12 may be formed from any convenient tubular stock, for example, glass tubing, wood tubing, metal tubing, and plastic tubing, and preferably is formed of resilient plastic tubing. One suitable handle material is a plastic drinking straw having an inner diameter of about 0.25 inch, marketed under the trade name "GLAD" and obtainable from First Brands Corp., Danbury, Conn., USA.

Slidably disposed within handle 12 and extending beyond first end 16 is a fiber bundle 22 which is folded within handle 12 to provide a compressed filament bulge 24 which in its non-compressed state has a diameter larger than the diameter of bore 14. The portion of bundle 22 extending beyond handle 12 defines the exposed bristles 26 of the brush which are available for work, for example, for touch-up painting, striping, dusting, scrubbing, glue application, soldering flux application, and the like. When bristles 26 become worn, ragged, fouled, or otherwise unfit for further use, the user may grasp the worn bristles, pull out a fresh length from the handle, and cut off and discard the original worn bristles, obtaining thereby a fresh exposure of bristles for further work. This sequence may be repeated numbers of times until all the fiber bundle has been used up. It is an advantage of the present invention that the fiber bundle is held in the tubular handle almost exclusively by friction between the filament bulge 24 and handle 12. Therefore, the locking force retaining the bundle in the handle remains high all the while the bundle becomes progressively shorter.

The filaments comprising bundle 22 and bristles 26 may be derived from any convenient fibrous material such as, for example but not limited to, hog bristles, horsehair, nylon fiber, polyolefin fiber, polyolefin yarn, polystyrene fiber, vegetable fiber, and metal wire fiber. Different fibers can provide different shapes to the bristle end. For example, using strands of polypropylene yarn will result in a brush having soft, fluffy bristles, as shown in FIG. 1*a*, whereas using strands of nylon monofilament will result in a brush having a well-defined, flat bristle area, as shown in FIG. 1*b*. Other characteristic bristle shapes and sizes are possible with other fibers.

Figures 2A, 2B, 2C, 2D:
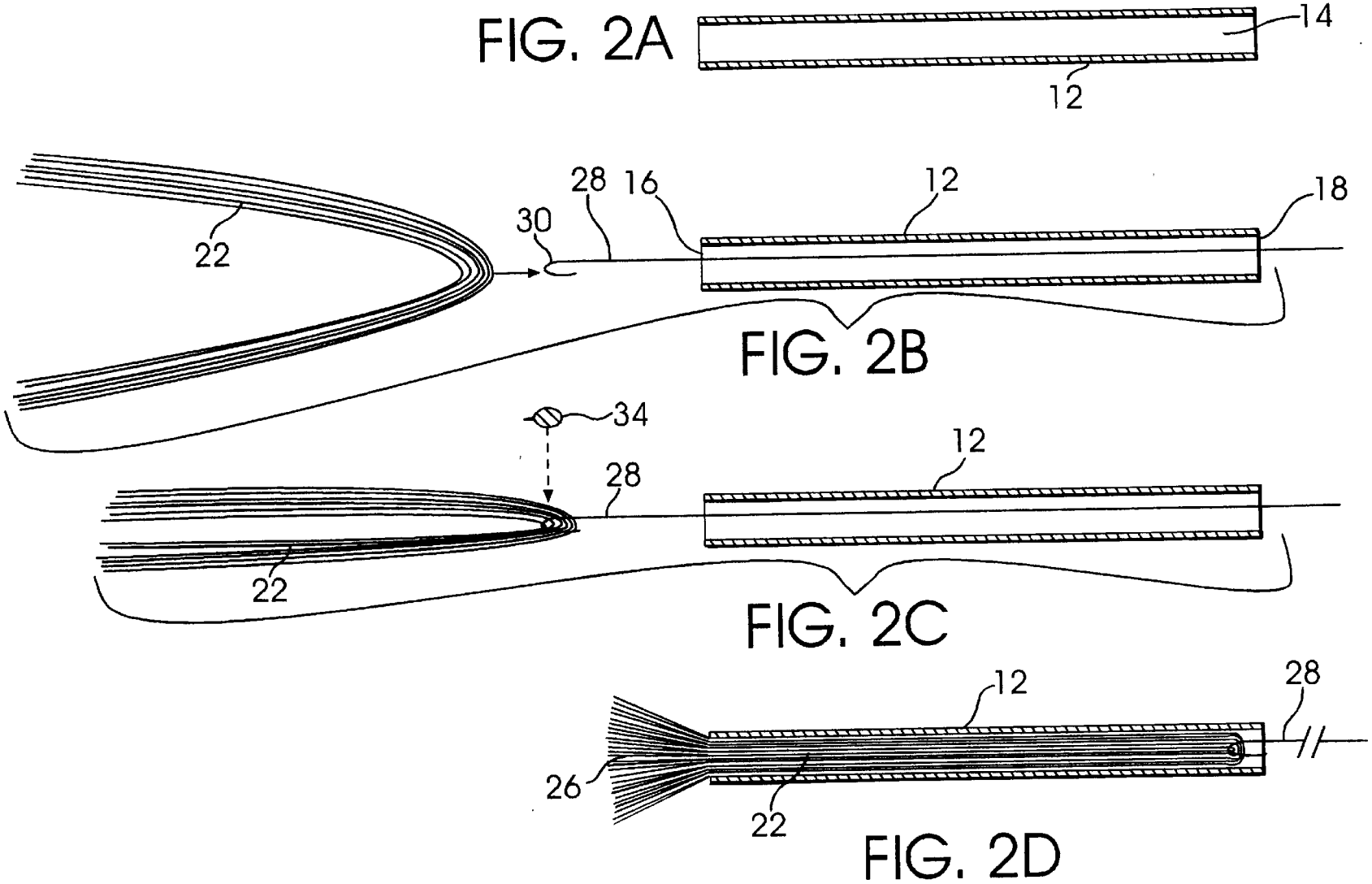

A brush in accordance with the invention may be made by the method illustrated in sequential FIGS. 2*a* through 2*d*. A hollow handle 12 open at first and second ends 16, 18 and having an axial bore 14 therein is provided, as shown in FIG. 2*a*. A longitudinal drawpiece 28 is extended through the axial bore beyond the first end 16, as shown in FIG. 2*b*. Preferably, drawpiece 28 is provided with a hook 30. A plurality of filaments is folded back on itself and is engaged on the drawpiece at the fold, forming a filament bulge 24 at the fold and a filament bundle 22 extending away from the drawpiece, the free ends of the filaments 32 all being at the end of the bundle opposite from bulge 24, as shown in FIG. 2*c*. Drawpiece 28 is then displaced axially of the handle to draw filament bulge 24 and a portion of filament bundle 22 into handle 12 through first end 16 of bore 14. Filament bulge 24 is compressed by being drawn into handle 12 and is engaged by friction with wall surface 20 of bore 14, the filament bundle thus being held slidably but securely within the handle by friction between said bulge and the wall until extracted physically therefrom. After placement of the filament bulge and bundle within the handle, the drawpiece may be disengaged from the bundle, reversed in direction, and removed from open end 16 or the drawpiece may be amputated at second end 18 and left in place. If desired, a shim 34 may be included in the bundle fold by placing the shim on the hook prior to engaging the fold, as shown in FIG. 2*c*, to increase the diameter of the bulge and thereby increase the magnitude of the frictional lock between the bulge and the bore wall.

Means other than a hook for engaging the folded bundle onto the drawpiece are within the scope of the invention, for example, clips, latches, adhesives, and the like. The drawpiece may also, for example, be a folded length of wire or filament like a lanyard whose loop is passed through the fold in the bundle and then may be pulled out of the fold by releasing one end of the lanyard and pulling on the other end upon completion of installation of the bundle into the handle.

An extendable-bristle brush can be manufactured in accordance with the method of the invention for very little cost, and with common materials for as little as a few cents per brush. Thus, this brush is economically suited to one-time uses, such as touching up small scratches in an automotive finish, as well as to repeated uses wherein the used bristles are cut off and discarded and new bristles are made available from within the handle for further work.

Another embodiment 36 of a brush in accordance with the invention includes a bellows portion 38 in handle 12, as shown in FIGS. 3 through 6*g*. The bellows consists of a cylindrically corrugated 39 portion of handle 12 which can be expanded and contracted axially of the handle to peristaltically lengthen or shorten, respectively, the handle, as described further below. A suitable handle having a bellows is a drinking straw also marketed by First Brands Corp. under the trade name GLAD FLEXIBLE STRAWS. The straw is provided with the bellows in the contracted position.

Figure 5:
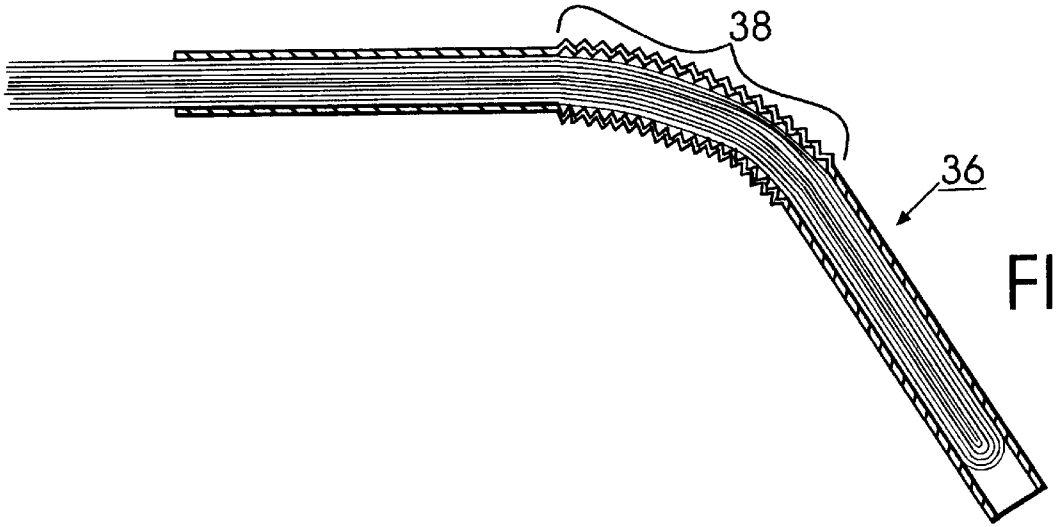
FIG. 5 is a view of the brush of FIG. 3 showing a bend in the handle permitted by the bellows.

Another advantage of providing a bellows portion in handle 12 of brush 36 is that the handle can be bent through an angle, as shown in FIG. 5, up to 90° or more, which can facilitate use of the brush in some applications, particularly those involving narrow spaces and corners which are not readily reachable by a comparable brush having an inflexible handle.

Figures 6A, 6B, 6C, 6D, 6E, 6F, 6G:
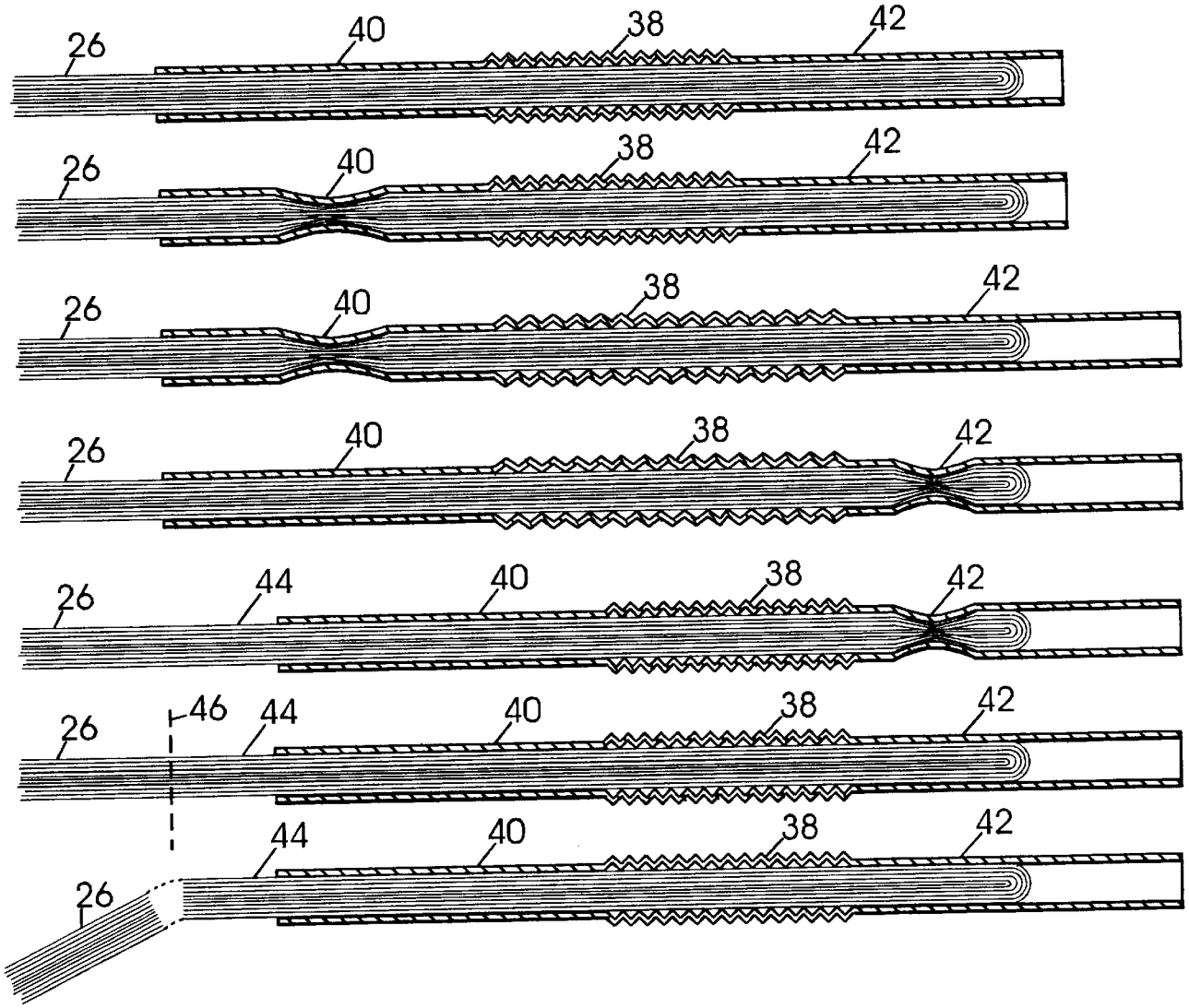

Another advantage of providing a bellows portion in handle 12 is that fiber bundle 22 may be advanced to provide fresh bristles without requiring the user to grasp the worn bristles and pull out fresh bristles as described above. This can be a substantial advantage when the worn bristles hold toxic or aggressive chemicals. A sequence for advancing the fiber bundle peristaltically to provide fresh bristles is shown in FIGS. 6*a* through 6*g*. The brush in FIG. 6*a* is identical with brush 38 in FIG. 3. First, the user compresses handle 12 as by pinching at region 40, between bellows 38 and first end 16, as shown in FIG. 6*b*, to arrest bundle 22 therein. Second, the user grasps and extends bellows 38 toward second end 16, which causes handle 12 to be extended and region 42 to slide over bundle 22 and bulge 24, as shown in FIG. 6*c*. Third, the user releases pressure in region 40, freeing bundle 22 to be slidable therein, and compresses region 42 to arrest bundle 22 therein, as shown in FIG. 6*d*. Fourth, the user retracts region 40 away from exposed bristles 26 to compress bellows 38 to a desired degree and thereby to advance a fresh desired length 44 of bristles from first end 16, as shown in FIG. 6*e*. Fifth, the user releases pressure in region 42 and decides at what length to cut the new bristles at line 46, as shown in FIG. 6*f*. Sixth, the user cuts the bristles and discards the old bristles 26, as shown in FIG. 6*g*., leaving a fresh working length of new bristles.

Figure 4:
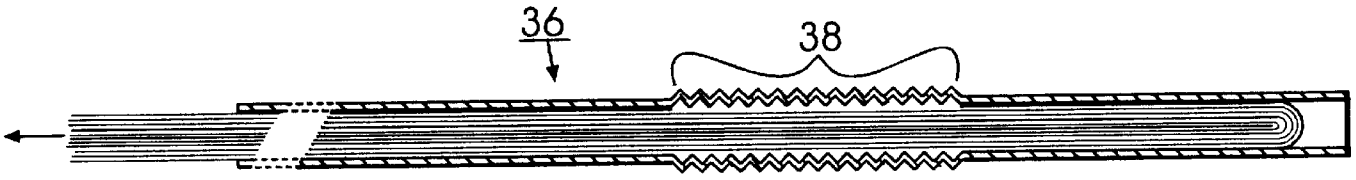
FIG. 4 is a view of the brush of FIG. 3 showing cutting off of the bristles and the end of the tubular handle to prepare for exposure of a fresh length of bristles.

Alternatively, the user may elect to first cut the tube and filament bundle therein simultaneously, as shown in FIG. 4, discarding the used bristles and a short portion of the tubular handle, and to then advance fresh bristles in the manner just described. Severing the handle with the contained bristles together can provide a very sharp edge to the new bristles. The trimming may be done at any desired angle to the handle, for example, at about a 30° angle as shown in FIG. 4.

In some applications, it can be desirable to retract the working bristles into the handle for some period of time, for example, to prevent glue in the bristles from drying out during time between uses. Retraction is easily accomplished by compressing the handle in region 42 and then expanding the bellows toward end 16 to retract bristles 44.

For most applications, tubular handles which are circular in cross-section 45 are suitable, as shown in FIG. 7*a*. Other shapes are possible, however, which may be polygonal, including square or rectangular 47 (FIG. 7*b*) and hexagonal 49 (FIG. 7*c*). Handles may be colored or colorless and may be opaque or transparent. Transparent handles can be useful in visually monitoring the amount of unused bristle fiber remaining within the brush.

Brushes in accordance with the present invention may be ganged or conjoined to form a larger or broader brush 48, as shown in FIGS. 8*a* and 8*b*, wherein four individual brushes 10*a* are bound together as by a bracket 50, which may be, for example, a semi-rigid plastic sleeve or trough or simply a length of adhesive tape wrapped around the brushes. Alternatively, brushes 10*a* may be joined as by adhesives or by thermal welding and the like. Brushes 36 may also be ganged into a larger brush like brush 48. Ganged brushes with or without bellows can be manipulated like the corresponding single brushes to expose fresh bristles.

A ganged brush may be substantially planar in cross-section, as shown in FIG. 8*b*, or may assume any other convenient cross-sectional shape, for example, a round brush as is known to be useful for cleaning parts in a solvent bath, as shown in FIG. 9. Individual brushes having differing filament materials may be included in a ganged brush.

From the foregoing description it will be apparent that there has been provided an improved extendable-bristle brush and an improved method for making extendable-bristle brushes. Variations and modifications of the herein described brushes and methods, in accordance with the invention, will undoubtedly suggest themselves to those skilled in this art. Accordingly, the foregoing description should be taken as illustrative and not in a limiting sense.

What is claimed is:

1. A method for making a brush, comprising the steps of:

a) providing a brush handle having an axial bore therethrough, said bore having first and second ends;

b) extending an elongated drawpiece through said axial bore beyond said first end of said axial bore;

c) engaging a fold of a plurality of filaments on said drawpiece forming a filament bulge at said fold and a filament bundle extending away from said bulge on said drawpiece; and d) displacing said drawpiece axially of said handle to draw said filament bulge and a portion of said filament bundle into said brush handle through said first end of said axial bore and to engage said filament bulge with the wall of said bore, said filament bundle being held securely within said handle by friction between said bulge and said wall until extracted physically therefrom.

2. A method in accordance with claim 1 further comprising the step of disengaging said filament bulge from said drawpiece and removing said drawpiece from said bore.

3. A method in accordance with claim 1 further comprising the step of trimming the free ends of said filaments in said filament bundle to provide an exposed length of free bristles extending from said first end.

4. A method in accordance with claim 1 further comprising the steps of:

a) severing simultaneously one of said ends of said handle and said fiber bundle contained therein; and b) advancing said fiber bundle in said handle to provide a desired length of exposed fiber bristle from said severed end of said handle.

5. A brush produced according to the process of claim 4.

6. A method in accordance with claim 1 wherein said drawpiece includes a hook, and said engaging step includes the step of folding said filaments around said hook.

7. A brush produced according to the process of claim 6.

8. A method in accordance with claim 5 further comprising the step of inserting a shim between said hook and said fold to increase the size of said filament bulge.

9. A brush produced according to the process of claim 8.

10. A brush produced according to the process of claim 1.

11. A brush, comprising:

a) a handle having an axial bore therethrough, said bore having first and second ends; and b) a folded bundle of filaments including a filament bulge at said fold, said bundle being slidably disposed in said axial bore so that the free ends of said filaments may be extended from said handle to form the bristles of said brush, said bulge being compressed within said bore so that said filaments are retained in said bore by friction between said bulge in and the wall of said bore.

12. A brush in accordance with claim 11 wherein said filaments are extended from said handle.

13. A brush in accordance with claim 11 wherein said filament bulge in a non-compressed state would be larger in diameter than the diameter of said axial bore.

14. A brush in accordance with claim 11 wherein said handle is a resilient tube.

15. A brush in accordance with claim 14 wherein a portion of said tube is a bellows.

16. A brush in accordance with claim 15 wherein said handle may be bent through said bellows to form an angle in said handle.

17. A brush in accordance with claim 14 wherein said resilient tube is substantially a drinking straw.

18. A brush in accordance with claim 11 wherein said handle is circular in cross-section.

19. A brush in accordance with claim 11 wherein said handle is polygonal in cross-section.

20. A brush in accordance with claim 11 wherein said fiber bundle contains fibers selected from the group consisting of hog bristles, horsehair, nylon fiber, polyolefin fiber, polystyrene fiber, vegetable fiber, and metal wire fiber.

21. A brush comprising a ganged plurality of individual brushes, each of said individual brushes being in accordance with the brush claimed in claim 11.

22. A brush in accordance with claim 21 further comprising a bracket for maintaining a desired shape of said ganged individual brushes.

23. A brush in accordance with claim 21 wherein individual ones of said plurality of brushes contain fibers formed of different materials.

24. In a brush having a fiber bundle slidable in a hollow resilient handle having colinear first and second sections and a colinear bellows portion therebetween, and the fiber bundle extending through said bellows portion, the method of advancing the fiber bundle through an opening at the outer end of said first section to provide a length of fresh bristles, comprising the steps of:

a) compressing the handle in the first section to arrest the fiber bundle therein;

b) extending the bellows to displace the second section away from said opening;

c) compressing the handle in the second section to arrest the fiber bundle therein;

d) releasing the handle in the first section to free the fiber bundle therein; and e) contracting the bellows to extrude a length of said fiber bundle from said opening to provide said fresh bristles extending from said opening.

25. In a brush having a fiber bundle slidable in a hollow resilient handle having colinear first and second sections and a colinear bellows portion therebetween, and the fiber bundle extending through said bellows portion, the method of retracting bristle extensions of the fiber bundle through an opening at the outer end of said first section comprising the steps of:

a) pinching said handle in said second section to arrest said fiber bundle therein; and b) extending said bellows to displace said first section along said fiber bundle to retract said bristles through said opening.

* * * * *